US005196145A

United States Patent [19]

Ishii et al.

[11] Patent Number: 5,196,145

[45] Date of Patent: Mar. 23, 1993

[54] TEMPERATURE SELF-CONTROLLING HEATING COMPOSITION

[75] Inventors: Takahito Ishii, Kyoto; Nobuyuki Hirai, Neyagawa; Tadataka Yamazaki, Katano, all of Japan

[73] Assignee: Matsushita Electric Industrial Co., Ltd., Osaka, Japan

[21] Appl. No.: 360,146

[22] Filed: Jun. 1, 1989

[30] Foreign Application Priority Data

| | | | |
|---|---|---|---|
| Jun. 1, 1988 | [JP] | Japan | 63-134997 |
| Jun. 28, 1988 | [JP] | Japan | 63-159983 |
| Jul. 26, 1988 | [JP] | Japan | 63-185911 |

[51] Int. Cl.[5] ..... H01B 1/06

[52] U.S. Cl. ..... 252/511; 219/505

[58] Field of Search ..... 252/511; 219/505

[56] References Cited

U.S. PATENT DOCUMENTS

| | | | |
|---|---|---|---|
| 3,823,217 | 7/1974 | Kampe | 264/105 |
| 4,177,446 | 12/1979 | Diaz | 252/511 |
| 4,658,121 | 4/1987 | Horsma et al. | 252/511 |
| 4,908,156 | 3/1990 | Dalle et al. | 252/511 |
| 4,909,960 | 3/1990 | Watanabe et al. | 252/511 |

FOREIGN PATENT DOCUMENTS

| | | |
|---|---|---|
| 0040537 | 5/1981 | European Pat. Off. . |
| 0098253 | 6/1983 | European Pat. Off. . |

*Primary Examiner*—Mark L. Bell
*Assistant Examiner*—Deborah Jones
*Attorney, Agent, or Firm*—Birch, Stewart, Kolasch & Birch

[57] ABSTRACT

The present invention provides a temperature self-controlling heating composition containing crystalline resins, elastomers and electrically conductive particles, and additional material for giving an affintiy to the resins and the elastomers if both are not compatible, in which the electrically conductive particles are stably dispersed in the medium of the resin and the elastomer, and the agglomeration of the dispersed particles can be prevented, even if the temperature exceeds the melting point of the crystalline resin because the apparent viscosity of the resin is not lowered so much by the network structure of the elastomers, so that the electrical resistance does not become lower even at such a high temperature.

5 Claims, 3 Drawing Sheets

TEMPERATURE SELF-CONTROLLING HEATING COMPOSITION

BACKGROUND OF THE INVENTION

Field of the Invention

The present invention relates to a temperature self-controlling heating composition having a positive temperature coefficient (referred to as PTC hereinafter), which can be used for a domestic heater such as a floor heater, a wall heater and the like.

Up to the present time, a temperature self-controlling heating composition which has been practiced is produced by the radiation crosslinking of a molded article of mixture of crystalline resins such as low density polyethylene and carbon black.

The electrical resistance of heating composition produced from a simple mixture of a crystalline resin and carbon black tends to sharply increase near the softening temperature (T1) of the crystalline resin and to decrease at a temperature higher than the melting point (T2), as shown by a solid line in FIG. 1. Accordingly, if the heating composition is heated by an outside heat source and the temperature of the composition rises higher than the melting point T2, the resistance of the composition becomes reduced and the temperature abnormally rises to a point which could possibly cause ignition. Further, there is a serious problem in that the resistance of the heating composition becomes gradually increased, and finally loses its heating ability, if an electrical potential is continuously or intermittently applied to the heating composition, even at ordinary temperatures.

The following is thought to be a cause of the above phenomenon. Although an electrical conductive path is formed in the case in which carbon black is homogeneously dispersed into a crystalline resin just after both are mixed, the carbon black, at a temperature higher than the melting point (T2) of the crystalline resin, begins a Brownian movement in the melted crystalline resin, and the Brownian movement increases as the temperature becomes higher, so that the opportunity for contact of adjacent carbon black increases. As the result of the above, the resistance reduces at a temperature higher than the melting point (T2) of the crystalline resin On the other hand, the reason for the increase of the resistance in the latter case, is considered to be that the electrical conductive path is interrupted by partial agglomeration (deterioration of dispersion) of the carbon black which will be induced by continuous or intermittent application of an electrical pressure.

Such agglomeration of carbon black will be caused by lower heat resistance of a crystalline resin, which is the dispersion medium for the carbon black. A heat saturated temperature of a temperature self-controlling heater is set up at a temperature lower than the melting point of the crystalline resin by about 20°-30° C., the reason being that the PCT property is dependent on the change of the specific volume of the crystalline resin in a melted state, and such a selection of the temperature that will be suitable. The heat saturated temperature, however, is a macrotemperature of the whole temperature self-controlling heating composition, and the microtemperature in the crystalline resin forming the electrical conductive path will rise higher than or near the melting point on some occasion. The crystalline resin will be sharply reduced in viscosity at a temperature higher than the melting point and become a liquid. The carbon black cannot be retained in the melted resin so as to partially agglomerate, and portions consisting of only the crystalline resin inherently insulative are formed within the electrical conductive path to make the heating composition highly resistive. As apparent from the above reasons, it had been considered difficult to stably retain carbon black dispersed in a crystalline resin alone. Therefore, a conventionally practiced heating composition is produced by the radiation crosslinking of a molded article made from a mixture of carbon black and a crystalline resin. As the crystalline resin subjected to the radiation crosslinking is improved in the heat resistance by the formation of a three-dimensional structure from the crystalline resin having a two-dimensional structure (prevention of the rapid change in physical properties near the melting point, especially decreases the viscosity), the agglomeration of the carbon black can be prevented. The relation of resistance (ordinate) and temperature (abscissa) of such an embodiment is shown in FIG. 1, in which the broken line indicates the resistance/temperature curve.

The temperature self-controlling heating composition containing such a crosslinked resin is too expensive because the cost of equipment for the radiation crosslinking is expensive, and is lacking in flexibility.

SUMMARY OF THE INVENTION

The object of the present invention is to provide economically a flexible temperature self-controlling heating composition improved in the aforementioned defects.

The heating composition of the present invention can be provided from a mixture of crystalline resins, elastomers having high temperature resistance and compatibility with said crystalline resin, and electrically conductive particles.

DETAILED DESCRIPTION OF THE INVENTION

Figure 1:
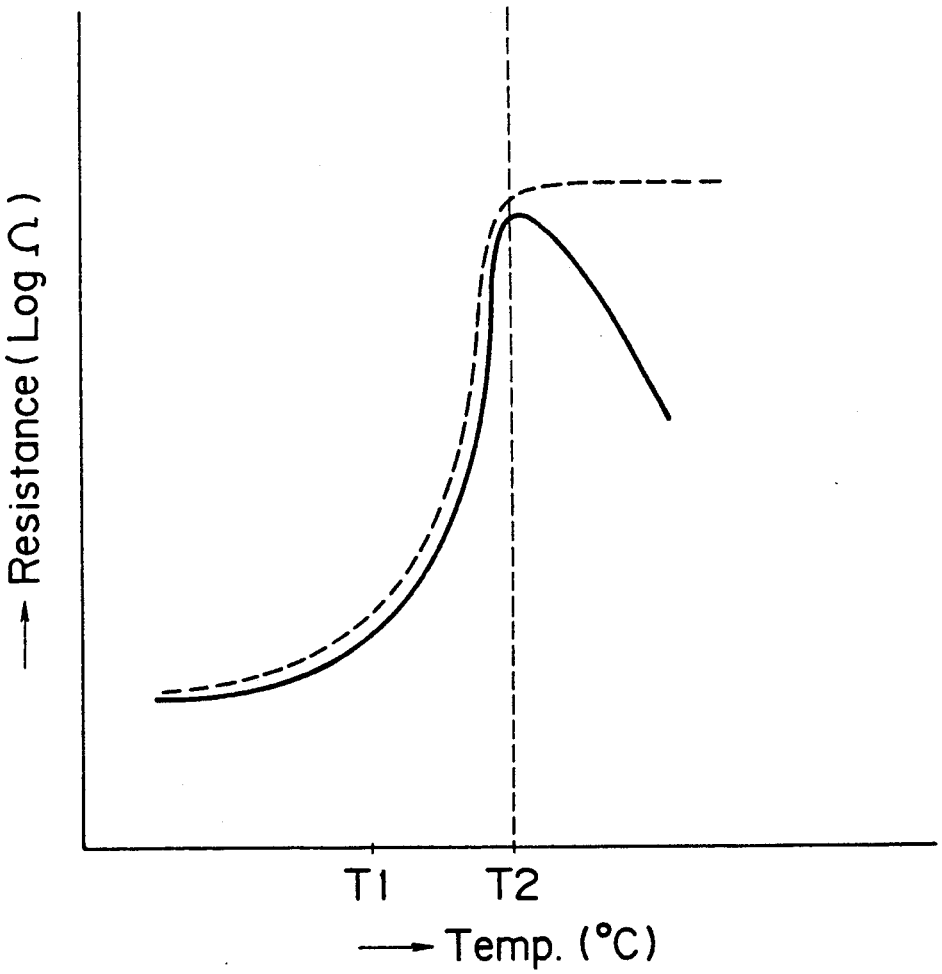
FIG. 1 is a graph showing the relation of electrical resistance and temperature in a conventional temperature self-controlling heating composition.

The first embodiment of the present invention is a temperature self-controlling heating composition which comprises crystalline resins, elastomers having high temperature resistance and compatibility with the crystalline resins, and electrical conductive particles.

The feature of the present invention is in that the heating composition comprises elastomers having high temperature resistance and compatibility with the crystalline resin. As aforementioned carbon black dispersed in crystalline resins is likely to agglomerate when the temperature of the heating composition rises higher than the melting point, and because the resin becomes a fluid, the electrical resistance sharply drops which leads to a rapid temperature rise in a conventional heating composition. In the present invention the elastomer contained in the composition prevents the electrical conductive particles dispersed in the crystalline resin from agglomerating even when the temperature exceeds the melting point of the crystalline resin. This is because the melted state of the crystalline resin is retained, due to the compatibility of the elastomer and the resin in the matrix formed with the network of the elastomer which has a three dimension structure, which prevents a significant lowering of the viscosity. When elastomers which are incompatible with the crystalline resin are used, a third material, especially a resinous material, which is compatible with both the resin and the elastomer may be additionally mixed with the two in such an amount that the crystalline resin and the elastomer would become mutually miscible. It is to be clearly understood that the same effect as obtained in the first embodiment can be obtained in such an embodiment.

Thus, the second embodiment of the present invention is a temperature self-controlling heating composition which comprises crystalline resins, elastomers having high temperature resistance and incompatible with said resins, materials compatible with both the resins and the elastomers, and electrically conductive particles.

The crystalline resin usable in the present invention may include polyethylene, polypropylene, polyoxymethylene, polyvinyl alcohol, modified polyethylene (e.g. maleic anhydride modified polyethylene), polymethylmethacrylate, polyvinylacetate, polyvinylchloride and the like. Polyethylenes including high density polyethylene, low density polyethylene, modified polyethylene and the like are especially of interest because of their chemical stability, inert property against any electrical conductive particles, and low price. If crystalline resins having polarity and electrically conductive particles having polarity on the surface such as carbon black are used in the same composition, the particle can be more stably dispersed in the resin due to the affinity induced by the polarities, which is also a preferable embodiment.

As examples of the preferable groups causing the polarity on the crystalline resin are hydroxyl groups, carboxyl groups, amino groups, aldehyde groups, ether groups, and the like.

The content of the crystalline resin in the composition is preferably about 15 to 60% by weight, more preferably about 25 to 45% by weight based on the total amount of the composition.

The elastomers compatible with the crystalline resin (referred to as elastomer (I)) are preferably selected from elastomers having a solubility parameter different from that of the crystalline resin by not greater than about 2, more preferably not greater than 1.8. The solubility parameter (SP) is defined by the following equation:

$$SP = \sqrt{\frac{\Delta E}{V}}$$

wherein ΔE represents evaporation energy, and V represents the molecular volume.

Preferable elastomer (I) is a thermoplastic elastomer. Examples of elastomer (I) usable in the present invention include, though it depends on the types of crystalline resin, styrene/butadiene rubber, maleic anhydride modified styrene/butadiene rubber, crosslinked ethylene propylene rubber, chlorinated rubber, chlorinated polyolefin and the like.

The content of elastomer (I) in the composition is preferably 15 to about 60% by weight, more preferably 25 to about 45% by weight based on the total amount of the composition.

The elastomers incompatible with the crystalline resin (referred to as elastomer (II)) preferably have solubility parameter of greater than 2. Elastomer (II) should have a network structure, and is preferably thermoplasticity, but with a melting point which is fairly higher than that of the crystalline resin. Elastomer (II) and the crystalline resin are to be used together. Preferable examples of elastomer (II) include polyester type elastomers and polyurethane rubber.

Elastomer (II) should be used together with materials which are compatible with both the crystalline resin and elastomer (II). These materials (referred to as a compatible material hereinafter) serve as a mediator between the resin and elastomer (II) in the composition to form a homogeneous mixture. The compatible materials may be resinous materials, elastomers, plasticizers, waxy materials, and the like. The most preferable ones are the resinous materials, for example, maleic acid modified resin and the like or elastomers. The compatible materials have a solubility parameter between those of the crystalline resin and the elastomer, and the differences in the solubility parameter from both are not greater than about 2, more preferably not greater than about 1.8, respectively.

The content of elastomer (II) is preferably about 15 to 60% by weight, more preferably about 25 to 45% by weight based on the total amount of the composition. The ratio of elastomer (II) to the compatible material is not restrictive, but the comparative material is preferably used at the percentage of from about 5 to 30 based on the total weight of the composition, and the compatible materials should be used in such an amount that the crystalline resin and elastomer (II) can be homogeneously mixed in the presence of the compatible materials.

Elastomer (II) may be used with an elastomer (I), or together with elastomer (I) and a compatible material. In the former case elastomer (I) itself acts as a compatible material. In the latter case elastomer (I) may or may not act as a compatible material. These embodiments should be, of course, interpreted as one of the embodiment of the present invention.

Electrically conductive particles according to the present invention may be carbon powders such as carbon black, graphite powders and the like; metal powders such as iron powders, copper powders, aluminum powders, nickel powders and the like; powders of ionizable materials such as metal oxides, carbonates, and the like; metal coated powders and the like. Most preferable electrically conductive particles are carbon black, because it has excellent dispersability properties due to its low gravity and affinity for crystalline resins in general, and it has a comparatively high electrical conductivity.

Preferable particle size of the electrically conductive particles is from about 20 to about 100 nm. The dispersability of the particle is improved as the particle size is smaller, but the Brownian movement becomes more active, and the electrical resistance of the composition is likely to change with a change in the temperature In the first embodiment the electrically conductive particles may be directly dispersed into melted crystalline resins, or initially dispersed into a small amount of crystalline resins and then mixed with the same or different melted crystalline resins.

In the second embodiment the electrically conductive particles may be directly dispersed into any of the melted mixture of crystalline resins, elastomers (II) and compatible materials, or initially dispersed into the melted crystalline resins, elastomers (II) and/or the compatible materials to provide a master batch, and then the master batch is dispersed into the other components, or any other such processes may be applicable. If extremely fine particles are used, it is preferable to initially disperse the particles into elastomers (II) to provide comparatively large particles, and to mix the obtained large particles into melted crystalline resins together with compatible materials. In this embodiment, the electrically conductive particles are dispersed into the elastomer (II) having the higher melting point, and the elastomer (II) containing the fine particles are dispersed in the crystalline resins, the fine particles can be restrained in the Brownian movement even when the temperature of the composition exceeds the melting point of the crystalline resins, and the elastomer particles are also restrained because of its largeness. Therefore, a lowering of the resistance at that temperature can be prevented.

The content of the electrically conductive particles are extremely dependent on the types of particles, especially specific conductivity, particle size, specific gravity and the like. Therefore, it cannot be defined simply, but in the case of carbon black, the content is preferably about 10 to about 60% by weight based on the total amount of the composition, more preferably about 15% to about 50%.

The temperature self-controlling heating composition of the present invention may contain another material, for example, electrically conductive resinous material, and so on.

The composition of the present invention can be molded into a plate, a sheet, a film, a rod and the like, or impregnated into or coated on a matrix such as a web, a net, a textile, a paper, a string, a sponge and the like, or coated on a sheet, a plate and the like, or filled into a tube, panels and the like.

The temperature self-controlling heating composition of the present invention is especially useful for a floor heater, a wall heater, a heater the prevention freezing and the like.

The present invention shall be illustrated according to following examples, but it should not be construed restrictively by these examples.

EXAMPLE 1

As a crystalline resin low density polyethylene (mp. 110 ° C.; Sumikathene E-104 available from Sumitomo Kagaku K. K.) 100 parts by weight, and as an elastomer compatible with the crystalline resin a polystyrene type thermoplastic elastomer (Kraton G 1650, available from Shell Chemical Co., Ltd.) 100 parts by weight were premixed by passing through pressure rolls heated at 170 ° C. 5 times, and then carbon black (particle size of 80 nm, 67 parts by weight, was blended by passing through the same pressure rolls heated at 170 ° C. 20 times to give a temperature self-controlling heating composition.

The heating composition obtained was rolled at 170° C. to a sheet having a thickness of about 0.7 mm, into which one pair of electrodes of copper wires (Φ0.3 mm×20 mm (L)) was parallelly buried along the longer side at interval of 1 mm. The obtained material was pressed at 170 ° C. for 2 hours, and then cooled to give a panel heater (10 mm (L)×4 mm (W)×1 mm (T)) for test.

The heater obtained has an electrical resistance of 30 Ω cm at 20° C., and 200 Ω cm at 80° C., and effectively and continuously generates heat for more than 100 hours when applied to with AC 100 V at 100° C.

EXAMPLE 2

As a crystalline resin to which a polarity is introduced a maleic anhydride modified high density polyethylene (mp. 130° C., SP value 8.0, Adomer HB 310, available from Mitsui Sekiyu Kagaku K. K.) 100 parts by weight, as an elastomer compatible with the above resin a maleic anhydride modified polystyrene type thermoplastic elastomer (SP value 9.0, Tuftec M1913 available from Asahi Kasei K. K.) 100 parts by weight were premixed with pressure rolls heated at 170° C. five times. Into the mixture carbon black (particle size of 80 mm, pH 8.0, Diablack G available from Mitsubishi Kasei K. K.) was blended by the same rolls at 170° C. 20 times to give a temperature self-controlling heating composition.

Using the heating composition obtained above a panel heater (10 mm×4 mm×1 mm) for test was produced in the same manner as described in the Example 1.

The heater obtained has an electrical resistance of 40 Ω cm at 20° C., and 180 Ωcm at 80° C., and effectively and continuously generates heat for more than 10000 hours when applied to with AC 100 V at 100° C.

EXAMPLE 3

Tuflec M1913, elastomer, 29 parts by weight and carbon black (Diablack G) 43 parts by weight were blended by pressure rolls heated at 200° C. 20 times to give a master batch. The obtained master batch 72 parts by weight and Adomer HB-310, crystalline resin, 28 parts by weight were blended by the same rolls at 170° C. 20 times to give a temperature self-controlling heating composition.

A panel heater (10 mm×4 mm×1 mm) for test was produced from the obtained heating composition in the same manner as described in the Example 1.

Figure 2:
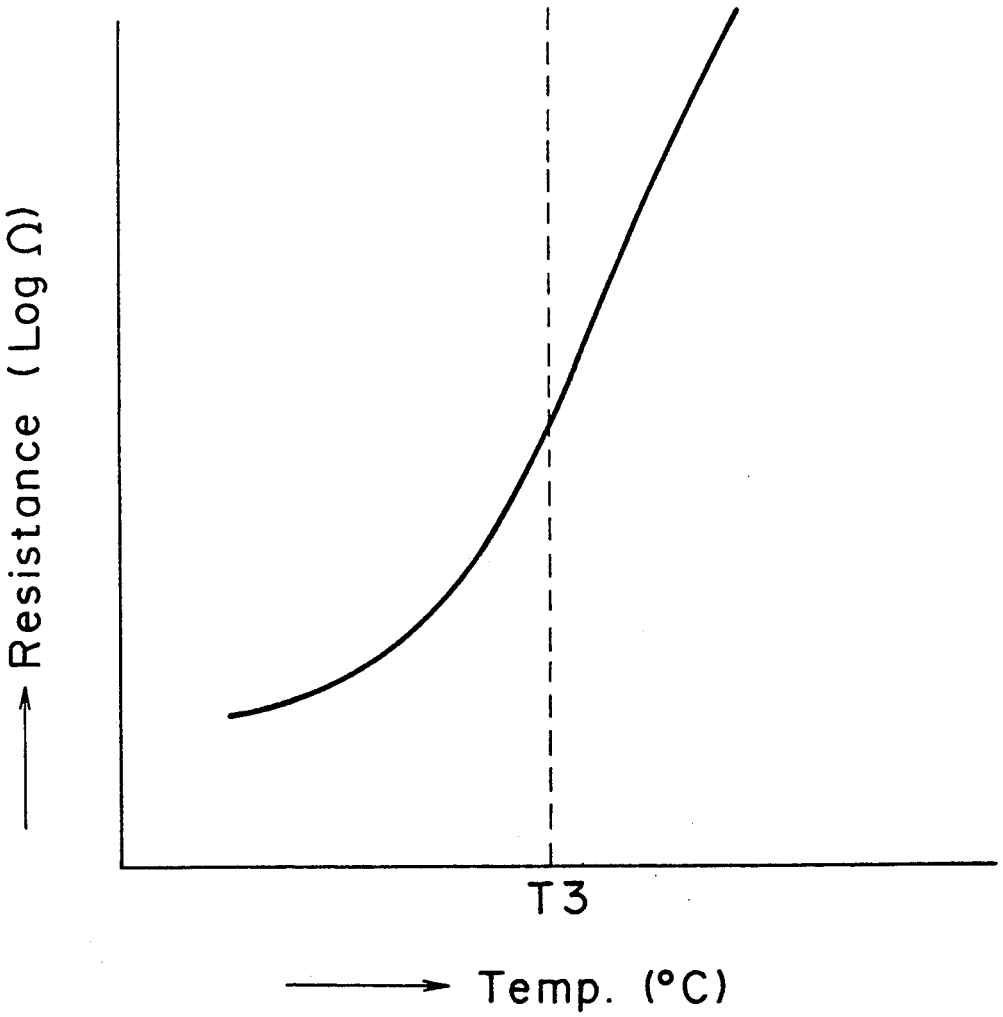
FIG. 2 is a graph showing the relation of electrical resistance and temperature in one embodiment of a temperature self-controlling heating composition of the present invention.

The heater obtained has an electrical resistance/temperature curve shown in FIG. 2, and effectively and continuously generates heat for more than 10000 hours when applied to with AC 100 V at 100° C.

EXAMPLE 4

As a crystalline resin a low density polyethylene (mp. 110° C., SP value 8.1, Sumikathene E 104 available from Sumitomo Kagaku K. K.);

as an elastomer having a heat resistance higher than the above crystalline resin and incompatibility with the same a polyester type thermoplastic elastomer (mp. 182° C., SP value 10.5, Hytrel 4047 available from Torey Du Pont K. K.);

as a third material compatible with both the crystalline resin and the elastomer a modified low density polyethylene (mp. 107° C., SP value 9.0, Bondine LX 4110 available from Sumitomo Kagaku K. K.); and as an electrically conductive particle carbon black (particle size of 80 nm, pH 8.0, Diablack G available from Mitsubishi Kasei K. K.) were used.

The carbon black 23 parts by weight and the elastomer 31 parts by weight were blended by pressure rolls at 200° C. 20 times to give a master batch, with which the crystalline resin 32 parts by weight and the third material 14 parts by weight were blended by the same rolls at 170° C. 20 times to prepare a temperature self-controlling heating composition.

A panel heater (10 mm>4 mm×1 mm) for test was produced from the obtained heating composition in the same manner as described in the Example 1.

Figure 3:
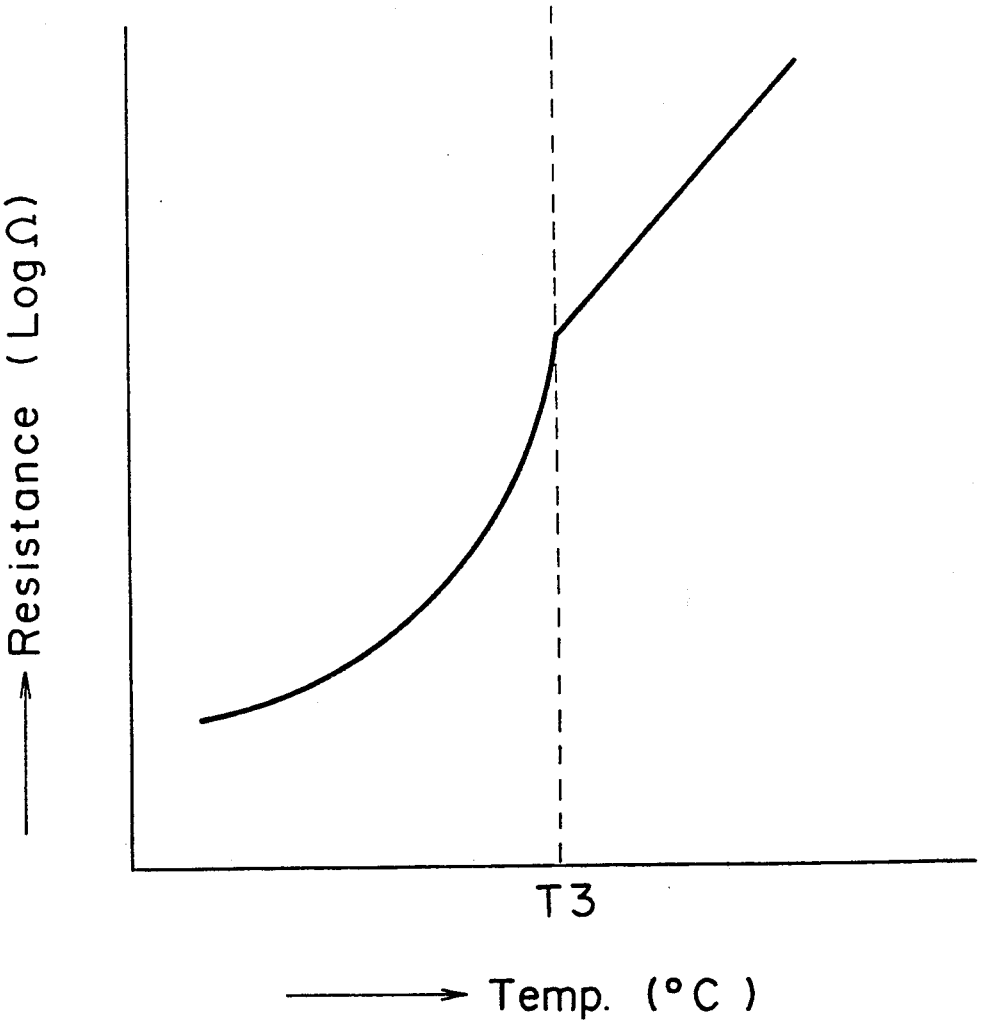
FIG. 3 is a graph showing the relation of electrical resistance and temperature in another embodiment of a temperature self-controlling heating composition of the present invention.

The heater obtained has an electrical resistance/temperature curve shown in FIG. 3, and effectively and continuously generates heat for more than 10000 hours when applied to with AC 100 V at 100° C.

As apparent from FIG. 2 and FIG. 3 heaters obtained from the heating composition of the present invention show excellent PTC property even over the melting point of the crystalline resin (T3) without any drop of resistance. Furthermore, the heater obtained has a flexibility due to the elastomer.

What is claimed is:

1. A temperature self-controlling heating composition which comprises:

(1) about 15 to about 60% by weight of a crystalline polyethylene or polyethylene modified with a polar group, (2) about 15 to about 60% by weight of an elastomer having compatibility with the crystalline polyethylene or polyethylene modified with a polar group and heat resistance higher than that of the crystalline polyethylene or polyethylene modified with a polar group, and (3) about 15 to about 60% by weight of carbon black.

2. The temperature self-controlling heating composition of claim 1, which is produced by blending the elastomer with the carbon black, followed by blending the resultant mixture with the crystalline polyethylene or the modified polyethylene.

3. The temperature self-controlling heating composition of claim 1, in which the modified polyethylene is a maleic anhydride modified polyethylene.

4. A temperature self-controlling heating composition which comprises:

(1) about 15 to about 60% by weight of a crystalline polyethylene or polyethylene modified with a polar group, (2) about 15 to about 60% by weight of an elastomer incompatible with the crystalline polyethylene or polyethylene modified with a polar group, and having heat resistance higher than that of the crystalline polyethylene or polyethylene modified with a polar group, (3) about 5 to about 30% by weight of a compatible resin having compatibility with both the crystalline polyethylene or polyethylene modified with a polar group and the elastomer, and (4) about 10 to about 60% by weight of carbon black. crystalline polyethylene or the modified polyethylene and the compatible resin.

5. The temperature self-controlling heating composition of claim 4, which is produced by blending the elastomer with the carbon black, followed by blending the resultant mixture with the crystalline polyethylene or the modified polyethylene and the compatible resin.

* * * * *

UNITED STATES PATENT AND TRADEMARK OFFICE

CERTIFICATE OF CORRECTION

PATENT NO. : 5,196,145

DATED : March 23, 1993

INVENTOR(S) : Takahito ISHII et al.

It is certified that error appears in the above-indentified patent and that said Letters Patent is hereby corrected as shown below:

Column 8, Claim 4, delete lines 26 and 27 in their entirety.

Signed and Sealed this

Twenty-second Day of August, 1995

*Attest:*

Bruce Lehman

BRUCE LEHMAN

*Attesting Officer*

*Commissioner of Patents and Trademarks*